United States Patent [19]

Hainaut

[11] Patent Number: 5,033,893

[45] Date of Patent: Jul. 23, 1991

[54] CASE WITH FIFIFORM MEMBERS AND WINDING DRUM

[75] Inventor: Laurent Hainaut, Vincennes, France

[73] Assignee: Raison Pure S.A., Paris, France

[21] Appl. No.: 520,639

[22] Filed: May 8, 1990

[30] Foreign Application Priority Data

May 12, 1989 [FR] France ..... 89 06243

[51] Int. Cl.[5] ..... A45D 40/04

[52] U.S. Cl. ..... 401/55; 401/68; 401/79; 401/86; 401/87

[58] Field of Search ..... 401/55, 68, 75, 86, 401/87, 79, 54, 81

[56] References Cited

U.S. PATENT DOCUMENTS 2,250,876 7/1941 Mitchell ..... 401/55
2,491,722 12/1949 Gelardin ..... 401/86 X
2,655,261 10/1953 Clark ..... 401/79

*Primary Examiner*—Steven A. Bratlie
*Attorney, Agent, or Firm*—Thomas R. Vigil

[57] ABSTRACT

A cylindrical case enclosing a movable cup (2) for carrying a stick (10) driven in an axial sliding motion by filiform members (4) which are windable on an axial drum (7) by means of a pivotal manual control (3).

10 Claims, 2 Drawing Sheets

CASE WITH FIFIFORM MEMBERS AND WINDING DRUM

BACKGROUND OF THE INVENTION

The present invention relates to the industry concerned with the packing of substances in the form of a stick, such as lipsticks, crayons and other cosmetic products, as well as hemostatic sticks and other pharmaceutical products, or polishes and other maintenance products.

Such substances are usually placed in protective cases from which the stick is made to project at the moment of use by a sliding of a shifting lug or a rotation of a control knob. An opposite operation causes the stick to withdraw into a protected position inside the case until the next utilization.

In some cases employing a shifting lug, the stick is supported by a cup connected to a band which is made to slide in a groove of the case which curves in a direction perpendicular to the axis of sliding; this is in particular the case of the case described in French patent No 663-721. Such cases have the advantage of being operable in one hand, but customers mostly prefer cases with a rotary control notwithstanding the fact that they require the use of both hands.

In conventional cases having a rotary control knob, the stick is supported by a cup which slides inside two concentric sleeves, the inner sleeve being connected to rotate with the control knob and defining two diametrically opposed longitudinal openings, while the outer sleeve is relatively fixed and defines two diametrically opposed helical grooves. Two radial lugs extending from the cup each extend respectively through a longitudinal opening and into a helical groove.

Thus, by a rotation of the inner sleeve relative to the outer sleeve by means of the knob the cup rises or descends in the case, depending on the direction of rotation of the knob. Many patents disclose such cases and in particular the French patent No. 916 237. These rotary-knob cases are generally favoured by customers but they comprise elements which are rather delicate to manufacture and assemble, in particular owing to the fragility of the apertured sleeves. There is also known from the document US-A-2 250 876 a case for a stick of a non-fluid substance applicable by rubbing on a surface, comprising a tubular body in which is slidable a cup supporting the stick, and a control coaxial with the body and pivotable at one end of the case for sliding the cup and causing the stick to project through one open end of the body or, by means of an opposite rotation of the control, causing it to withdraw into the body; the cup in the body is connected to one end of at least one semi-flexible windable filiform member, i.e. a member which is laterally flexible but longitudinally rigid whose other end is connected to a winding drum which is coaxial with and connected to the pivotal control; formed in the inner surface of the tubular body is at least one longitudinal guide groove for each filiform element.

In this document, the control can only be rotated in a single direction for causing the stick to project from the case.

SUMMARY OF THE INVENTION

The invention has for object to provide a case which is simple to produce, comprises a minimum number of easily assembled parts, is cheap and has a control which is rotatable indifferently in one direction or the other for causing the stick to project from the case.

The invention provides a case for a pasty stick comprising:

- a tubular body in which is slidably mounted a cup for carrying the stick;
- a control pivotally mounted at one end of the body;
- at least one semi-rigid filiform member having one end inserted on the cup and an opposite end inserted in a zone of a winding drum formed on an appendage of the control;
- at least one longitudinal guide groove formed in the body for the filiform member;
- characterized in that the end of the filiform member inserted on the drum is inserted longitudinally on a lateral zone of the drum and a free annular space for the winding of the filiform member between the drum and the body is provided by:
- on one hand, a shoulder on the inner surface of the body leading to a body region of increased diameter, said shoulder being connected to said longitudinal groove,
- on the other hand, a shoulder on the outer surface of the drum leading to a drum region of increased diameter, said shoulder being connected to the zone in which the filiform member is inserted on the drum.

Thus, by rotating the control in one direction or the other, the filiform member whose end is disposed longitudinally is spontaneously deformed between said connections of the two considered shoulders in such manner as to be wound in one direction or the other on the drum in the region of said free space.

Advantageously, the zone of insertion of the filiform member is formed by a flat surface connecting two drum regions of increased diameter.

In a first embodiment, the pivotal control is mounted at the base of the case and is extended inside the body by the cylindrical drum whose distal part has a diameter less than the diameter of the proximal part by at least twice the diameter of a filiform member and serves to wind the filiform members, with respect to said free annular space provided in the inner surface of the tubular body for housing the windings of the filiform members, the distal part of the drum being connected to the proximal part thereof by said circular shoulder which curves toward the end of each filiform member fixed on the proximal part, the drum presenting, in confronting relation to each filiform member said flat surface which corresponds to a chord of a segment of a circle whose height is at least equal to the diameter of a filiform member In a second embodiment, the case comprises a tubular sleeve freely slidable between the body and the cup and internally provided with at least one longitudinal guide groove for each filiform member, in the extension of the grooves of the body, and presenting in the vicinity of each of its ends an inner abutment shoulder for the cup, the sleeve driven by the cup, which is itself driven by the filiform members, moving telescopically out of the body and withdrawing therein upon a desired rotation of the pivotal control.

In a third embodiment, the pivotal control is mounted at the top of the case the open end of which it surrounds, and is extended inside the case by an annular skirt acting as a winding drum, the distal end of which presents a shoulder curving toward the end of each filiform member fixed in the proximal part of the skirt, and having a thickness greater than the diameter of a filiform member, a free annular space being provided in the inner surface of the tubular body for housing the windings of the filiform members in confronting relation to the proximal part of the skirt.

It is usually advantageous to arrange that the filiform members be at least two in number and symmetrically spaced apart.

In a practical embodiment, the pivotal control, the stick-carrying cup and the filiform members constitute a monobloc unit which may be moulded in a single piece, the pivotal control being freely rotatably clipped in one end of the body.

The structure of the cases according to the invention lends itself particularly well to making its elements of transparent plastics material allowing the stick to be seen inside the case and the user to check the colour in the case of a makeup product, with no need to shift the stick out of the case.

BRIEF DESCRIPTION OF THE DRAWINGS

The invention will be more readily understood from the detailed description of the accompanying drawings which represent some embodiments of the invention chosen merely as examples from many embodiments, adaptations and variants of the invention which may be imagined by one skilled in the art.

In the drawings.

DESCRIPTION OF THE PREFERRED EMBODIMENTS

Figure 1:
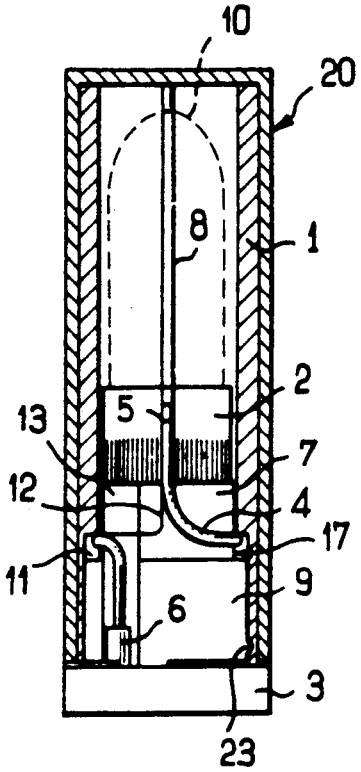
FIG. 1 is a diagrammatic elevational view, partly in section, of a first embodiment of a case according to the invention, with the stick completely withdrawn and the case closed by its cap.

In these figures, the like elements are designated by like reference numerals some of which are provided with an index. The dimensions and the respective proportions of these elements are not necessarily respected in order to render the drawings more clear.

The case shown in FIGS. 1 to 6 mainly comprises a substantially tubular body 1 capped by a cap 20 and an assembly (FIGS. 4 to 6) comprising a base 3, two filiform members, threads or wires 4, 4' and a cup 2 carrying the stick 10. One end 6, 6' of the filiform members is fixed laterally to the proximal part 9 of a cylindrical coaxial appendage or drum 17 extending the base 3, whose distal part 7, which is also cylindrical but has a smaller diameter, serves to wind the filiform members. The other end 5, 5' of the filiform members is laterally fixed to the cup. The proximal and distal parts are connected by a shoulder 12 which curves toward the ends 6, 6' of the filiform members and merges into a flat face 13 in the extension of each end of a filiform member; the radial set back of the flat face 13, which is only slightly larger than the diameter of a filiform member, permits its free movement in confronting relation to the inner surface of the body 1. The diameter of the distal part 7 is substantially the same as the diameter of the cup 2 and only slightly smaller than the inside diameter of the upper region of the body 1 but smaller than the diameter of the proximal part 9 by about twice the diameter of a filiform member. Formed in the inner surface of the body 1, in the upper region, are two longitudinal grooves 8, 8' which act as a guide for the filiform members which slide therein. The open section of these grooves is homothetically a little larger than that of the filiform members so as to ensure that they are axially well guided and laterally well retained. At the base of the body 1, these grooves open onto a lower and enlarged region forming a part whose inside diameter is only slightly larger than the diameter of the proximal part 9, by a curved flared shape 19 in a direction which is the opposite of that of the shoulder 12 between the distal part 7 and proximal part 9. This flared shape 19 is extended by an annular shoulder or ledge 21 whose hollow profile is homothetically a little larger than a half profile of the filiform member. An annular free space 11 provided between the shoulder 12 and the ledge 21 houses the filiform members wound on the distal part 7. The base 3 is clipped to be freely rotatable in the base of the body 1 by an annular rib 22. A stop 23 carried by the base 3 cooperates with abutments at the end of the body for limiting the rotation of the assembly comprising the base, the filiform members and the cup in the body between the withdrawn and extended positions of the stick 10. The base 3, whose outside diameter is larger than the diameter of the body 1, acts as a manual pivotal control for operating the case. For aesthetic reasons, its outside diameter is advantageously the same as the outside diameter of the cap 20, and the colours of the body, the cap and the base may be identical or different.

Figure 7:
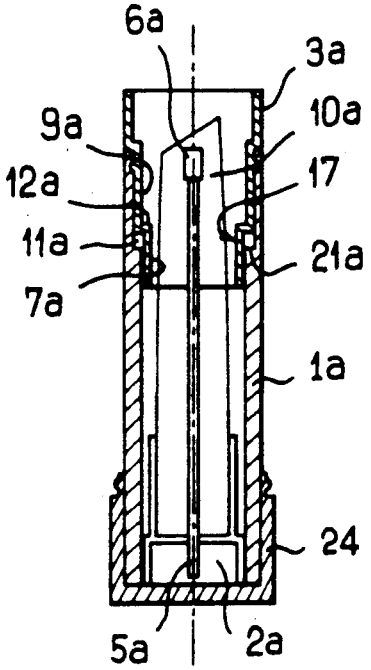
FIGS. 7 and 8 are elevational views, partly in section, of a second embodiment of a case according to the invention having a mechanism which is inverted relative to that of FIGS. 1 to 6, respectively in the position in which the stick is withdrawn and the position in which the stick extends out of the case.
Figure 8:
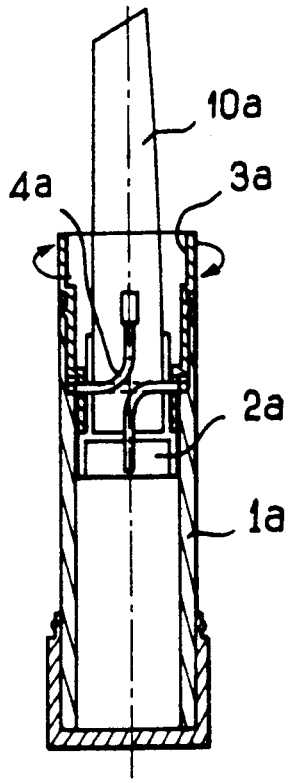

In the second embodiment shown in FIGS. 7 and 8, the mechanism is inverted in that the pivotal manual control **3*a* surrounds the opening of the body 1*a* and the end of the stick 10*a* in the withdrawn position of the stick. It is extended within the case by a drum or an annular skirt 17 whose distal part 9*a* serves to wind the filiform members 4*a* connecting the proximal part 7*a* of the skirt to the cup 2*a***.

As in the first embodiment of FIGS. 1 to 6, the shoulder **12*a* between the proximal and distal parts of the skirt, and the ledge 21*a* defining the flared end of the body in which the proximal part of the skirt is pivotal, are curved in the opposite direction toward the end 6*a* of the filiform members 4*a* fixed to the outer wall of the proximal part 7*a* so as to guide them as they are wound in a free space 11*a* provided between the shoulder 12*a* and the ledge 21*a*. Longitudinal grooves formed in the inner wall of the body 1*a* guide the filiform members as they slide therein. A blind base member 24** is fitted on the base of the body and closes the latter.

This second embodiment has the advantage of permitting the construction of shorter cases for a given stick.

Figure 2:
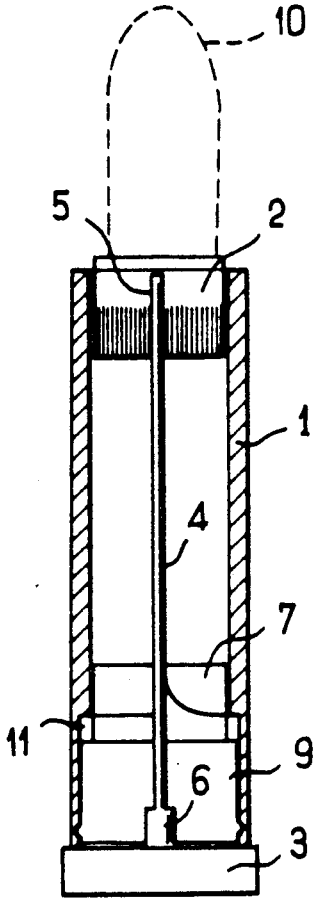
FIG. 2 is a view similar to FIG. 1 of the same case with the stick in its outermost position and the cap removed.
Figure 3:
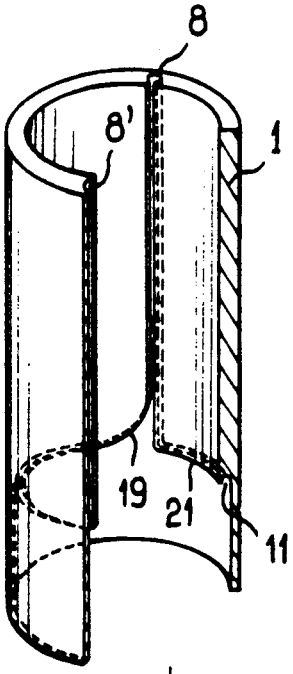
FIG. 3 is a perspective view, partly in section, of the body of the case of FIGS. 1 and 2.
Figure 4:
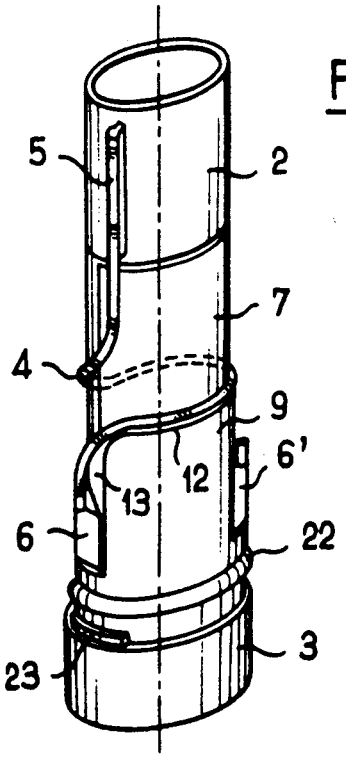
FIGS. 4, 5, and 6 are perspective views of the assembly comprising a pivotal control, filiform members and stickcarrying cup of the case of FIGS. 1 and 2, respectively in the withdrawn position, a halfway position and a completely extended position.
Figure 5:
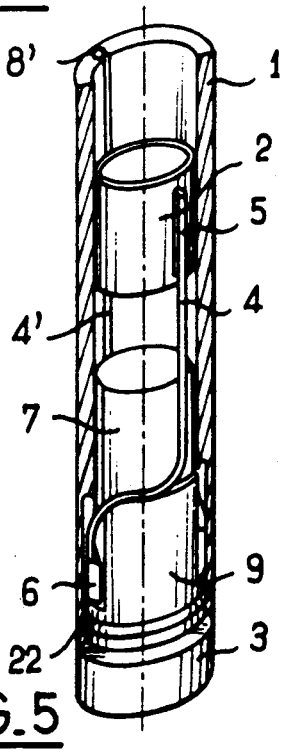
Figure 6:
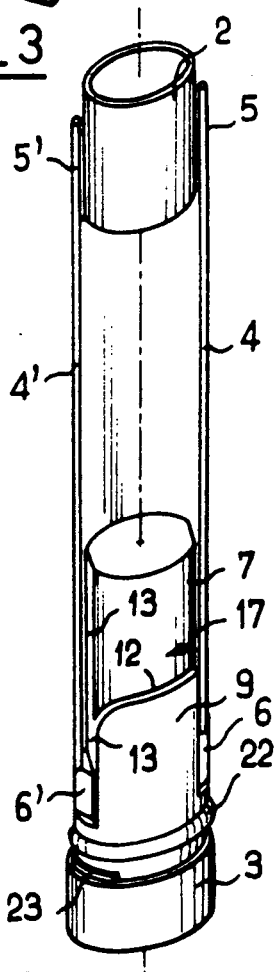
Figure 9:
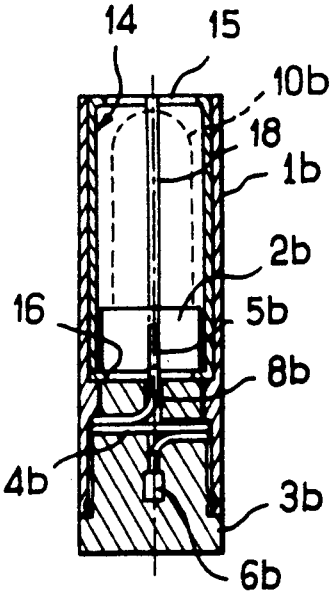
FIGS. 9 and 10 are views similar to FIGS. 7 and 8 of a third embodiment of a case according to the invention with a telescopic mechanism.
Figure 10:
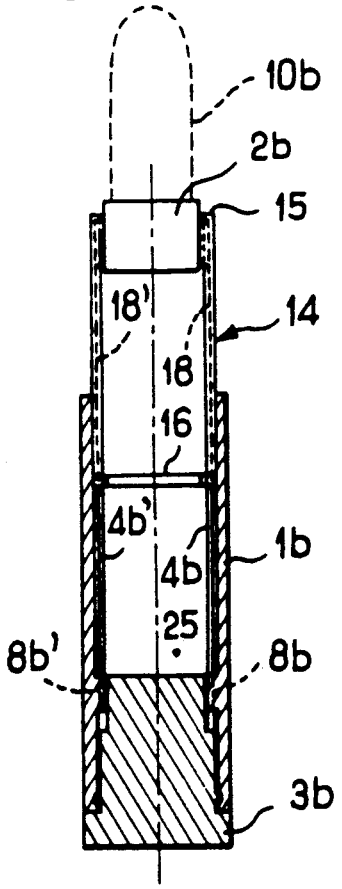

The third embodiment of a case according to the invention shown in FIGS. 9 and 10 incorporates the essential features of the first embodiment of FIGS. 1 and 2 with a pivotal control 3*b* in the base of the body 1*b*. The guide grooves 8*b*, 8'*b* for the filiform members 4*b*, 4'*b* in the body 1*b* are relatively reduced and open onto a larger part 25 of the body 1*b* in which is freely slidable a tubular sleeve 14 in which is slidable the cup 2*b* carrying the stick 10*b*. This sleeve is provided internally with longitudinal grooves 18, 18' in the extension of the grooves 8*b*, 8'*b* of the body 1*b* for guiding the filiform members 4*b*, 4'*b*. The sleeve 14 is provided at each end with an inner abutment shoulder 15, 16 limiting the sliding of the cup between the ends of the sleeve. Consequently, when the control 3*b* is rotated for unwinding the wound filiform members 4*b*, 4'*b*, the stick being in the withdrawn position (FIG. 9), the cup 2*b* slides in the sleeve 14 from the lower abutment shoulder 16 to the outer abutment 15, then drives the sleeve outwardly of the body 1*b* until the filiform members are completely unwound, as shown in FIG. 10. At this moment, the user is provided with a stick support which is easier to handle and has a length which is about one and a half times the length of the closed case. When the filiform members are again wound so as to withdraw the stick into the case, the cup 2*b* slides in the sleeve 14 to the base abutment 16 and then drives the sleeve fully into the body 1*b* as shown in FIG. 9.

In these various embodiments, the filiform members are two in number, but it is possible to imagine similar devices having a single filiform member or three, four or more filiform members preferably evenly spaced apart.

The assembly comprising the cup, the filiform members and the pivotal control may be produced by the assembly of the various parts composed of various materials, by adhesion, welding or soldering, mechanical fitting together, or any other known interconnecting means, before mounting in the body. But this assembly may also be made in a single piece, advantageously moulded from a plastics material, for example acetal resin. The body, the cap, optionally the sleeve and the base may also be made from various materials, but they may be advantageously moulded from a plastics material, for example polystyrene.

A part, or all the parts of the case may easily be produced from transparent materials so as to reveal the stick inside the case and permit ascertaining its appearance and in particular its colour.

The special structure of the mechanism for shifting the cup in a case according to the invention permits its application to cases of various sectional shapes which are not of revolution, as was imperative with previous conventional cases having relatively rotatable concentric sleeves. Consequently, the invention permits a combination of certain advantages of cases controlled by a shifting lug as concerns the freedom of the shape of the stick and its case, with the advantages of the smooth operation of cases having a rotary control.

What is claimed is:

1. Case for a pasty stick, said case comprising:

a tubular body defining an inner surface having a region of enlarged diameter, a cup for carrying the stick slidably mounted in said body, a control pivotally mounted at an end of said body, an appendage of said control, a winding drum formed on said appendage and defining an outer surface having a region of enlarged diameter and a lateral zone, at least one semi-rigid filiform member having a first end inserted on said cup and a second end inserted on said lateral zone longitudinally relative to said drum, at least one longitudinal guide groove formed in said body for guiding said at least one filiform member, said body and said drum defining an annular free space for a winding of said at least one filiform member by:

a first shoulder of said inner surface of said body leading to said region of enlarged diameter, said shoulder being connected to said longitudinal groove, and a second shoulder of said outer surface of said drum leading to said region of enlarged diameter, said second shoulder being connected to said zone of insertion of said at least one filiform member on said drum.

2. Case according to claim 1, wherein said lateral zone of insertion of said at least one filiform member is formed by a flat face interconnecting two regions of enlarged diameter of said drum.

3. Case according to claim 1, wherein said control is located at the base of said case.

4. Case according to claim 1, comprising a tubular sleeve freely slidably mounted between said body and said cup, at least one longitudinal guide groove for said at least one filiform member formed internally in said tubular sleeve in the extension of said at least one longitudinal guide groove formed in said body, and defining in the vicinity of each of opposite ends of said tubular sleeve an inner abutment shoulder for said cup, a desired rotation of said pivotal control causing said tubular sleeve selectively to extend telescopically from said body and to withdraw into said body, said tubular sleeve being driven by said cup and said cup being driven by said at least one filiform member.

5. Case according to claim 1, wherein said pivotal control is annular and mounted at an upper end of the case, said pivotal control surrounding an open end of said case, an annular skirt extending said pivotal control inside said case, said skirt acting as a winding drum having a distal end defining a shoulder which curves toward the end of said at least one filiform member fixed in a proximal part of said skirt and having a thickness greater than the diameter of said at least one filiform member, an annular free space being provided in the inner surface of said tubular body for housing windings of said at least one filiform member in confronting relation to said proximal part of said skirt.

6. Case according to claim 1, comprising at least two of said at least one filiform member symmetrically spaced apart.

7. Case according to claim 1, wherein said pivotal control, said cup and said at least one filiform member constitute a monobloc unit.

8. Case according to claim 7, wherein said unit is moulded in one piece.

9. Case according to claim 1, comprising means for clipping said pivotal control in an end of said body to be freely rotatable relative to said body.

10. Case according to claim 1, wherein at least component parts of said case which surround said stick are transparent.

* * * * *